United States Patent [19]

Lewis

[11] 4,183,423

[45] Jan. 15, 1980

[54] LADDER HOIST

[76] Inventor: James P. Lewis, 19306 NE. 29th Ave., Ridgefield, Wash. 98642

[21] Appl. No.: 835,159

[22] Filed: Sep. 21, 1977

Related U.S. Application Data

[63] Continuation of Ser. No. 713,858, Aug. 12, 1976, abandoned.

[51] Int. Cl.[2] ..... B66B 9/20

[52] U.S. Cl. ..... 182/103; 182/127; 182/142; 187/10

[58] Field of Search ..... 182/102, 103, 142, 178, 182/20; 187/9, 10, 11

[56] References Cited

U.S. PATENT DOCUMENTS

| | | | |
|---|---|---|---|
| 976,240 | 11/1910 | Winkler | 182/103 |
| 2,855,072 | 10/1958 | Drummond | 182/10 |
| 2,943,708 | 7/1960 | Sasgen | 187/10 |
| 3,282,375 | 11/1966 | Ray | 182/20 |
| 3,289,787 | 12/1966 | McSwain | 182/20 |

*Primary Examiner*—Reinaldo P. Machado
*Attorney, Agent, or Firm*—Klarquist, Sparkman, Campbell, Leight, Hall & Whinston

[57] ABSTRACT

A cart bolted to a short bottom section of a ladder carries a winch. A cable on the winch runs over a pulley on a short top section of the ladder and is connected to a carriage having wheels running in channel-like side members of the ladder. The carriage has an adjustable, folding platform and a back which pivots to a horizontal position when the carriage reaches the top of the ladder. A bottom pushbutton control and a top pushbutton control are provided.

2 Claims, 6 Drawing Figures

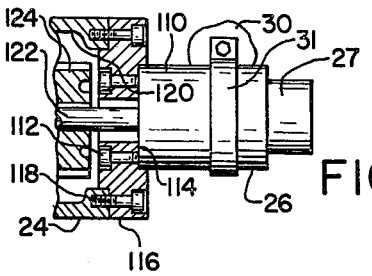
FIG.3
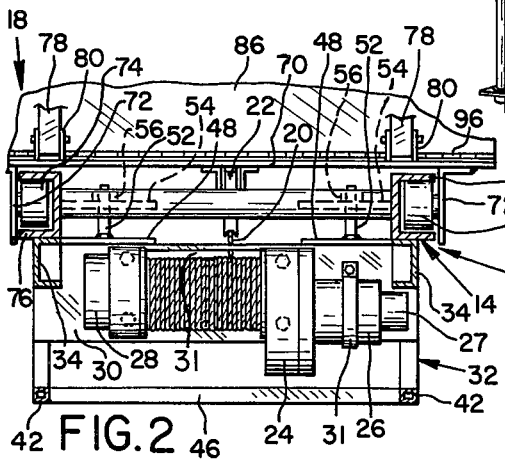
FIG.2
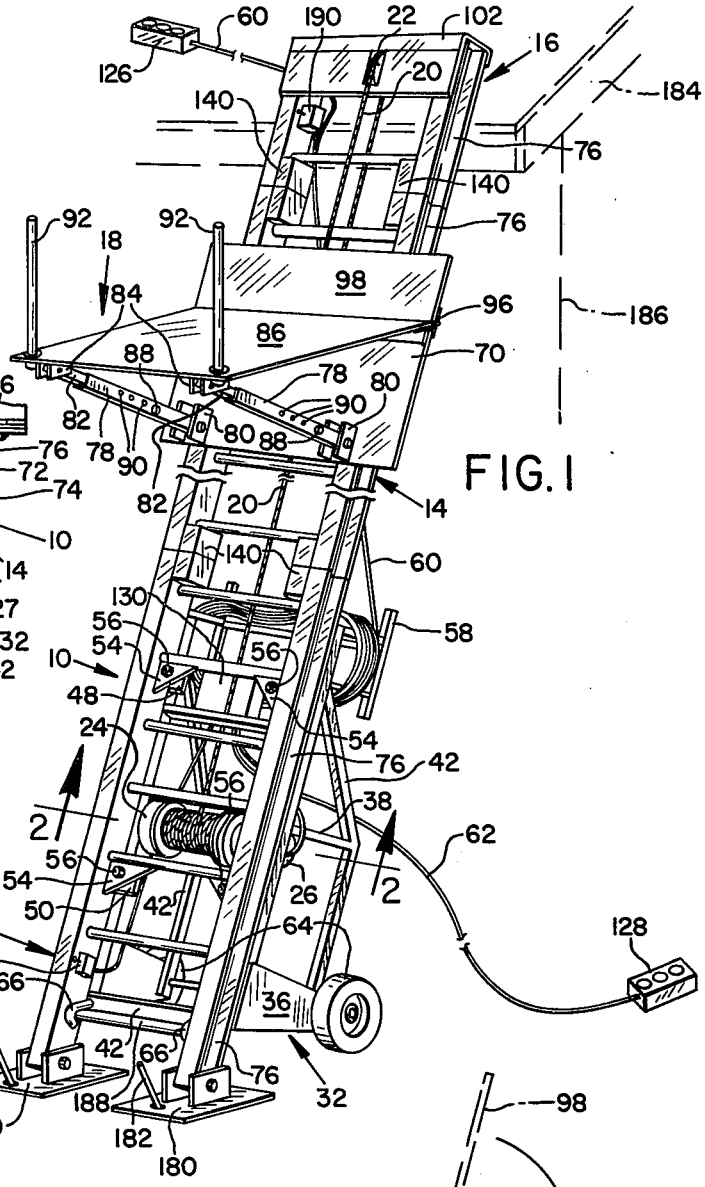
FIG.1
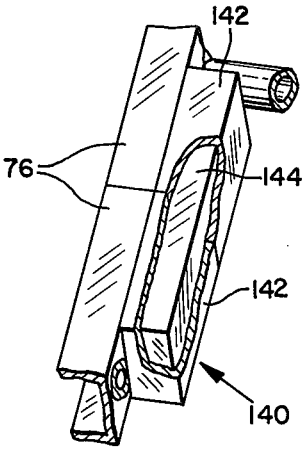
FIG.4
FIG.6
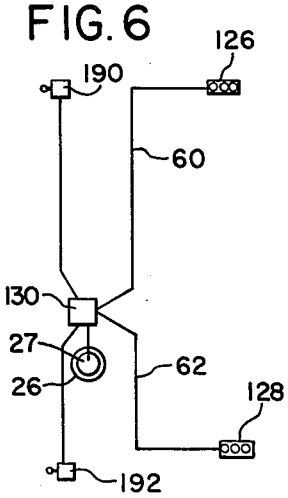
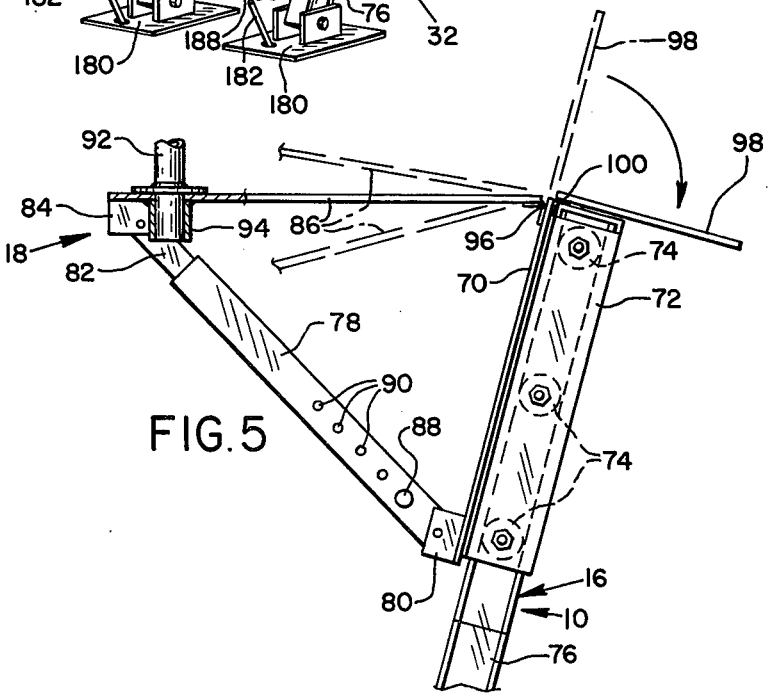
FIG.5

LADDER HOIST

This is a continuation of application Ser. No. 713,858, filed Aug. 12, 1976, now abandoned.

DESCRIPTION

This invention relates to an improved ladder hoist, and has for an object thereof the provision of a new and improved ladder hoist.

Another object of the invention is to provide a ladder hoist including a winch carried by a cart attachable to the ladder.

A further object of the invention is to provide a ladder hoist including a winch attached to a bottom section of a ladder and a top section of the ladder carrying a pulley.

In the drawings:

FIG. 1 is a perspective view of a ladder hoist forming one embodiment of the invention;

FIG. 2 is an enlarged, horizontal, sectional view taken along line 2—2 of FIG. 1;

FIG. 3 is an enlarged, fragmentary, horizontal sectional view of an adapter connecting a motor and winch of the hoist;

FIG. 4 is an enlarged, fragmentary, perspective view of a ladder joint of the hoist;

FIG. 5 is an enlarged, fragmentary, partially sectional side elevation view of the hoist; and FIG. 6 is a schematic view of a control circuit of the hoist.

A ladder hoist forming one specific embodiment includes a ladder 10 having a bottom section 12, one or more middle sections 14 and a top section 16. A carriage 18 is pulled up the ladder by a cable 20 extending from the carriage up over a pulley 22 and down to a winch 24 driven by an electric motor 26 and brakable by a brake 28.

The winch 24 (FIG. 2), the motor 26, and the brake 28 are mounted by bolting and a stop 31 on a plate 30 of a cart 32. The plate 30 has a slot 31 to allow the cable 20 to traverse the spool of the winch. The plate 30 is welded to top channel members 34 welded to legs 36 and frame members 38, 40, 42 and 44. Crossbraces 46 are welded to the members 42. Mounting plates 48 and 50 are welded to the cart frame, and studs 52 welded to the mounting plates 48 and 50 are releasably secured to gussets 54 by nuts 56. The cart 32 also includes a spool 58 for winding remote control cords 60 and 62 thereon. The cart can be detached from the ladder, the top section 16 disconnected from the middle section 22, the carriage 18 disconnected from the ladder, and the carriage and top section placed on and secured to the lower section of the ladder, or taken off altogether. The cart with its wheels 64 can then be moved like a wheelbarrow anywhere desired. The cart also includes hooks 66 which are adapted to hook over lower rung 88 of the ladder in assembling the cart on the ladder. Also, if desired, the cart may be left secured to the bottom section 12 of the ladder, the middle sections removed, the top section 16 assembled with the bottom section to form a compact unit transportable where desired by the cart.

The carriage 18 (FIGS. 1, 2 and 5) includes a frame plate 70, on which angle members 72 mounting rollers 74 are secured. The rollers project into and roll along outwardly facing track-like channels 76 forming the longitudinal members of the ladder sections 12, 14 and 16. Tubular arms 78 are pivotally mounted on clevises 80 welded to the plate 70, and tubular arms 82 pivotally mounted on clevises 84 welded to platform plate 86 telescope in the arms 78 as limited by stop pins 88 placeable in selected ones of pairs of holes 90 in the arms 78 to make the platform level. The platform carries stakes 92 in sockets 94, and is hinged to the plate 70 by piano hinge 96. A back plate 98 normally lies against the ladder, and is secured to frame plate 70 by piano hinge 100. However, when the carriage 18 reaches its upper limit the plate 98 moves by gravity to a substantially horizontal position as shown in full lines in FIG. 5 and resting on top cover member 102 welded to tops of members 76 of the top section 16.

The motor 26 (FIG. 3) has a housing 110 secured by capscrews 112 in a socket 114 in an adapter plate 116 secured by capscrews 118 to housing 120 of the winch with shaft 122 extending into and keyed to driving gear 124 of the winch. The winch is controlled by pushbutton controls 126 and 128 (FIG. 6) connected to known circuitry in control box 130 mounted on the cart. Limit switches 132 and 134 fixed to the top and bottom sections 16 and 12 limit travel of the carriage.

The side rail members 76 of the several sections are detachably connected together by joints 140. Each joint includes opposed tubular sockets 142 welded to the inside faces of the upper and lower members 76 of a joint, and pins 144 fitting closely in and telescoping the members 76. Pins 182 are driven through feet 180 pivotally attached to the lower ends of the members 76 of the lower section 12. Rungs 188 are welded to the members 76.

The cart 32 may be detached from the lower section 12 and operated like a wheelbarrow. Or, if desired, the lower section 12 is left bolted to the cart and the adjacent section 14 is disengaged from the lower section, the top section 16 then is disengaged from its adjacent section 14 and joined to the bottom section 12. The cart then can be used to carry the lower section 12 and top section 16 therewith.

What is claimed is:

1. In a ladder hoist, a sloping, ladder having tracks, a frame, rollers in the tracks and supporting the frame in a position substantially parallel to the ladder, a platform pivotally connected to the top of the frame, adjustable brace means connected to the frame and the platform, and a back plate pivotally connected to the top of the frame.

2.

a ladder, a cart attachable to and detachable from the ladder, winch means mounted on the cart, and carriage means movable by the winch means up the ladder, the carriage means including frame means lying along the ladder, a support platform hinged to the frame means and a back plate hinged to the platform.

* * * * *

UNITED STATES PATENT AND TRADEMARK OFFICE

CERTIFICATE OF CORRECTION

PATENT NO. : 4,183,423

DATED : January 15, 1980

INVENTOR(S) : James P. Lewis

It is certified that error appears in the above-identified patent and that said Letters Patent are hereby corrected as shown below:

Column 2, line 56, After "2." insert --In a ladder hoist,--.

Signed and Sealed this

*Thirteenth* Day of *May 1980*

[SEAL]

*Attest:*

SIDNEY A. DIAMOND

*Attesting Officer*

*Commissioner of Patents and Trademarks*